US008650761B2

(12) United States Patent
Haas

(10) Patent No.: US 8,650,761 B2
(45) Date of Patent: Feb. 18, 2014

(54) FASTENING APPARATUS

(75) Inventor: Guenter Haas, Kaufering (DE)

(73) Assignee: Hilti Aktiengesellschaft, Schaan (LI)

( * ) Notice: Subject to any disclaimer, the term of this patent is extended or adjusted under 35 U.S.C. 154(b) by 374 days.

(21) Appl. No.: 13/193,305

(22) Filed: Jul. 28, 2011

(65) Prior Publication Data

US 2012/0192437 A1 Aug. 2, 2012

(30) Foreign Application Priority Data

Jul. 30, 2010 (DE) ..... 10 2010 038 675

(51) Int. Cl.
*B27B 9/04* (2006.01)

(52) U.S. Cl.
USPC ..... 30/375; 30/373; 30/293

(58) Field of Classification Search
USPC ..... 30/373, 375, 293
See application file for complete search history.

(56) References Cited

U.S. PATENT DOCUMENTS

| | | | | | |
|---|---|---|---|---|---|
| 2,002,676 | A * | 5/1935 | Owens | 33/446 |
| 2,800,933 | A * | 7/1957 | Michael | 30/373 |
| 3,043,351 | A * | 7/1962 | Davis | 30/373 |
| 3,087,519 | A * | 4/1963 | McCarty et al. | 30/376 |
| 4,128,940 | A * | 12/1978 | Ong | 30/373 |
| 4,356,748 | A * | 11/1982 | Tilton | 83/745 |
| 4,414,745 | A * | 11/1983 | Kuhlmann et al. | 30/373 |
| 4,628,608 | A * | 12/1986 | Kuhlmann et al. | 30/373 |
| 5,035,061 | A * | 7/1991 | Bradbury et al. | 33/430 |
| 5,427,006 | A * | 6/1995 | Finley | 83/574 |
| 5,901,450 | A * | 5/1999 | James | 30/373 |
| 5,964,041 | A * | 10/1999 | Daniel | 33/403 |
| 6,757,981 | B2 * | 7/2004 | Hampton | 30/372 |
| 7,059,225 | B1 * | 6/2006 | Rabell | 83/13 |
| 7,246,446 | B2 * | 7/2007 | Adkins | 33/42 |
| 7,516,552 | B2 * | 4/2009 | Yoshida | 30/373 |
| 7,661,194 | B1 * | 2/2010 | Ende | 30/376 |
| 7,950,156 | B2 * | 5/2011 | Nickels et al. | 30/373 |
| 2006/0005404 | A1 * | 1/2006 | Adkins | 33/42 |
| 2006/0042102 | A1 * | 3/2006 | Lukens | 30/373 |

FOREIGN PATENT DOCUMENTS

| | | |
|---|---|---|
| DE | 196 50 877 A1 | 6/1998 |
| GB | 2 319 987 A | 10/1998 |

OTHER PUBLICATIONS

European Search Report, dated Sep. 23, 2011, 7 pages.
German Search Report, dated Jan. 14, 2011, 2 pages.

* cited by examiner

*Primary Examiner* — Sean Michalski
(74) *Attorney, Agent, or Firm* — Crowell & Moring LLP

(57) ABSTRACT

A fastening apparatus for a limit stop element of an electric hand tool, in particular a hand circular saw, is disclosed. The fastening apparatus includes a guide, into which the limit stop element can be inserted and along which it can be displaced, and a locking mechanism, which can lock the limit stop element in the displacement direction. The locking mechanism has a spring element, which, in its locked position, clamps the limit stop element with a clamping force directed against the limit stop element and, in a released position, permits a displacement of the limit stop element.

12 Claims, 2 Drawing Sheets

FASTENING APPARATUS

This application claims the priority of German Patent Document No. 10 2010 038 675.8, filed Jul. 30, 2010, the disclosure of which is expressly incorporated by reference herein.

BACKGROUND AND SUMMARY OF THE INVENTION

The invention relates to a fastening apparatus for a limit stop element of an electric hand tool, in particular a hand circular saw, having a guide, into which the limit stop element can be inserted and along which it can be displaced, and a locking mechanism, which can lock the limit stop element in the displacement direction.

To precisely guide a hand tool, for example to be able use a hand circular saw to execute a cut that runs as straight and as parallel to an edge as possible, these tools have a parallel guide with a limit stop element, which can be applied to a guide edge, e.g., an edge of the workpiece being processed, and can be guided along the edge. Such a limit stop element allows the angle and the distance to a guide edge to be adjusted preferably in a continuously variable manner. A fastening apparatus for such a limit stop element is provided on the hand tool, which makes a stable fixation of the limit stop element on the hand tool possible.

Fastening apparatuses that have been used until now for such a limit stop element have a guide, into which a rail-like limit stop element is inserted and along which guide displacement can occur. Normally a screw is provided for fixing the rail, which presses the rail against the guide and thereby clamps it between the screw and guide. The disadvantage of fixation with a screw is that with inadequate maintenance, contamination or with high tightening forces, detaching the screw and thus the fastening apparatus is hampered. This problem is compounded by the often small dimensions of the screw head, which requires a great manual force in order to grasp the screw and unscrew it. In extreme cases, loosening the screw without a tool is not possible. Furthermore, the screws get lost easily.

The object of the invention is creating a fastening apparatus of the type mentioned at the outset which makes it possible to adjust the limit stop element with low operating forces quickly and without tools.

According to the invention, this is achieved in the case of a fastening apparatus of the type mentioned at the outset in that the locking mechanism has a spring element, which, in its locked position, clamps the limit stop element preferably with a clamping force directed against the limit stop element and, in a released position, permits a displacement of the limit stop element. The locking is thus accomplished not by a screw, but by a spring element, which, in a locked position, clamps the limit stop element. To change the position of the limit stop element, the spring element is moved against the spring force into the released position, thereby overriding the locking of the limit stop element. After the correct position is adjusted, the spring element is released so that it automatically returns to the locked position. As a result, firstly, quick locking of the limit stop element is possible thereby reducing the danger that the limit stop element will be displaced again after the correct position has been adjusted. Secondly, adjustment of the limit stop element without tools is a given.

The clamping force is preferably aligned essentially perpendicular to the displacement direction of the limit stop element so that there can be no adjustment of the position of the limit stop element by the spring element.

The spring element preferably has a recess through which the limit stop element extends. In other words, the limit stop element is guided through the spring element. As a result, first of all, the limit stop element is guided securely. And secondly, a slipping off of the limit stop element from the spring element is safely ruled out.

The clamping of the limit stop element is achieved for example in that, in the locked position, the spring element is canted with respect to the limit stop element. In other words, in the released position, it is possible for the limit stop element to be displaced in the guide in the displacement direction. In the locked position, the position of the spring element changes in such a way that the spring element is adjacent with two edges on the limit stop element, wherein the edges act on the limit stop element with opposing forces and clamp it.

The limit stop element is thus not pressed by the spring element against another, fixed component and clamped between it and the spring element, but is held exclusively on the spring element in the displacement direction.

The canting is achieved in that the recess of the spring element is a slot, whose height preferably corresponds essentially to that of the limit stop element and whose width is preferably greater than the width of the limit stop element. In this embodiment, in the locked position, the spring element is more strongly inclined to a plane perpendicular to the displacement direction than in the released position. In other words, in the released position, the projection of the recess is wider on the plane perpendicular to the insertion direction than the width of the limit stop element. The limit stop element can thus be inserted without resistance into the fastening apparatus in the displacement direction. After positioning the limit stop element, the spring element is released so that it returns to the locked position, in which the angle to the plane perpendicular to the displacement direction is greater. In this position, because of the greater angle to the plane, the width of the projection of the recess on this plane is less than the width of the limit stop element. In other words, the edges of the recess of the spring element make contact with the limit stop element and cant thereon, thereby locking the limit stop element. Thus, no moveable parts other than the spring element are necessary on the fastening apparatus so that no maintenance expense is required for the fastening apparatus.

In order to achieve a better hold of the limit stop element, the recess is limited by edges, wherein the surfaces adjacent to the edges preferably converge at a right angle, in particular to form a sharp edge. In other words, the spring element is adjacent to the limit stop element exclusively with the sharp edge, thereby increasing the contact pressing force and thus the clamping force of the spring element may be increased.

The edges are produced in particular by cutting the recess without subsequent deburring.

The spring element preferably has a mounting end as well as a freely cantilevered end. The spring element is designed in particular to be elongated. In other words, the spring element is, for example, a spring steel sheet, which is mounted on the fastening apparatus on one end and is able to spring with the freely cantilevered end.

In the locked position, this spring element is preferably arranged obliquely to the displacement direction.

A single spring element, which cants the limit stop element, makes locking the limit stop element only in one direction possible. However, if the limit stop element is moved against the displacement direction, the limit stop element can press the spring element from the locked position into the released position, whereby a releasing of the locking may occur. In order to prevent this, two spring elements are provided in a preferred embodiment, which, with respect to the displacement direction of the limit stop element, run obliquely and non-parallel to each other. In other words, the spring elements and their clamping forces act in the respective opposite directions, wherein one spring element locks the limit stop element in a displacement direction and the second spring element locks the limit stop element in the opposite direction.

The spring elements may be connected to one another to form one piece, preferably to form a U, with a base running in the direction of the displacement direction and two spring elements inclined thereto, wherein the U is designed in particular as a mirror image to a plane perpendicular to the displacement direction. The spring elements are thus configured as a single component, whereby only one common fastening is required for both. Fastening the spring elements to the fastening apparatus is thereby simplified considerably. In this case, the spring elements have the same spring stiffness so that the clamping forces of both the spring elements and thereby the holding forces are equal in both directions. Because the spring elements are designed as a U, operation is furthermore simplified, because the spring elements have to be pressed against each other to move in the released position, which is possible in a simple manner, for example, by gripping both legs of the U.

The spring elements are arranged in the displacement direction of the limit stop rail before and after the guide so that the same may be operated without limitations by the guide or other components. The spring elements may also be pressed against the guide for example, thereby additionally creating a limit stop, which prevents the spring elements from being pressed together too far.

Instead of a direct operation of the spring elements, it is also conceivable for an additional actuating element to be provided for operating the spring elements, in particular an eccentric. As a result, any arrangement of the spring elements is conceivable, for example at a better protected position within a housing. Moreover, the operating element may be constructed such that it simultaneously operates both spring elements.

In addition, according to the invention, a parallel guide is provided on an electric hand saw, with a fastening apparatus according to the invention and with a limit stop element, which is inserted into the guide and is locked in a detachable manner by locking mechanism.

The limit stop element preferably has a lower hardness than the spring element. The adjustment of the limit stop element in particular takes place in a continuously variable manner.

Additional features and details of the invention are disclosed in the following description and in the drawings to which reference is made.

DETAILED DESCRIPTION OF THE DRAWINGS

Figure 1:
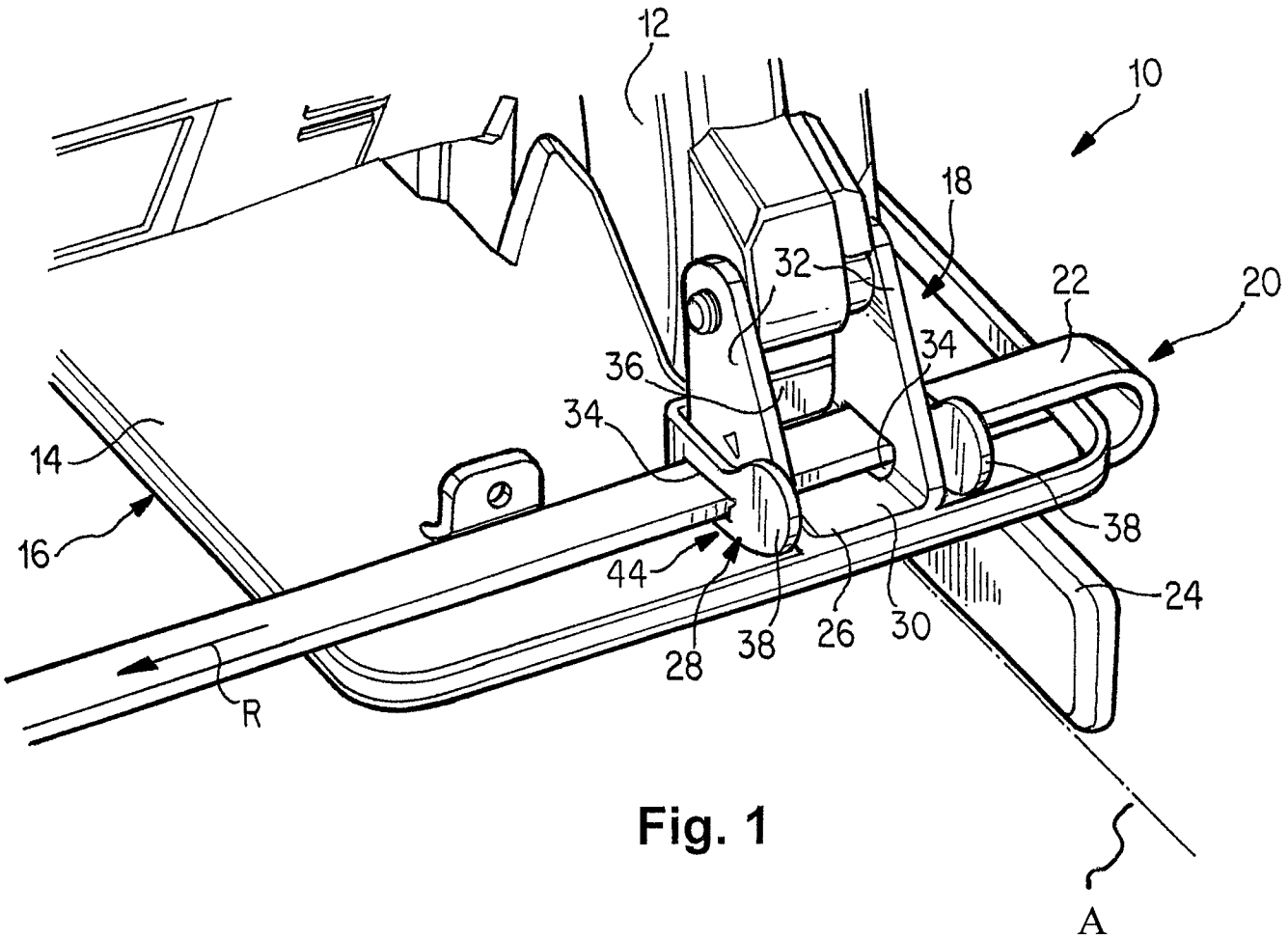
FIG. 1 is a perspective view of a parallel limit stop according to the invention.

FIG. 1 shows a section of a hand tool, in this case a hand circular saw 10. The hand circular saw 10 has a saw blade, which is arranged under a protective cover 12 and is aligned along a cut line A, and a tool support plate 14, which has a recess, through which the saw blade exits on the underside 16 of the tool support plate 14. The hand circular saw 10 is placed with the underside of the tool support plate 14 on the workpiece to be processed and guided in the direction of line A.

In order to be able to guide the hand circular saw 10 safely in the direction of line A, a limit stop element 20 is provided, which can be locked in a continuously variable manner on the tool support plate 14 of the hand circular saw with a fastening apparatus 18. The limit stop element 20 has a longish limit stop rail 22, which is guided in a U-shape around the tool support plate 14 and bears a limit stop plate 24, which is fastened thereto perpendicular to the limit stop rail 22 and runs parallel to or along line A.

As will be described in the following, the limit stop element 20 may be displaced with the limit stop rail 22 in a displacement direction R, which runs perpendicular to axis A, into the fastening apparatus 18 and locked therein. The limit stop plate 24 is thereby aligned parallel to line A at a suitable distance from the saw blade. The limit stop plate 24 may be disposed, for example, on a guide rail or on an edge of the workpiece to be processed and guided along the same so that an exact cutting guidance of the hand circular saw 10 is possible.

The fastening apparatus 18 has a guide 26, in which the limit stop element 20 or the limit stop rail 22 is guided in the displacement direction R as well as a locking mechanism 28 in order to be able to lock the limit stop element 20 in the fastening apparatus 18.

The guide 26 in this case is formed by a U-shaped plate, which has a base 30 fastened on the tool support plate 14 as well as two legs 32 that project at right angles from the tool support plate 14. The legs 32 each have a slot-like opening 34 through which the limit stop element 20 may be inserted in the displacement direction R with the limit stop rail 22. The dimensions of the openings 34 correspond essentially to the cross-section of the limit stop rail 22 so that it is mounted displaceably in the guide 26 in the displacement direction R and is held transverse thereto with almost no play.

Figure 2:
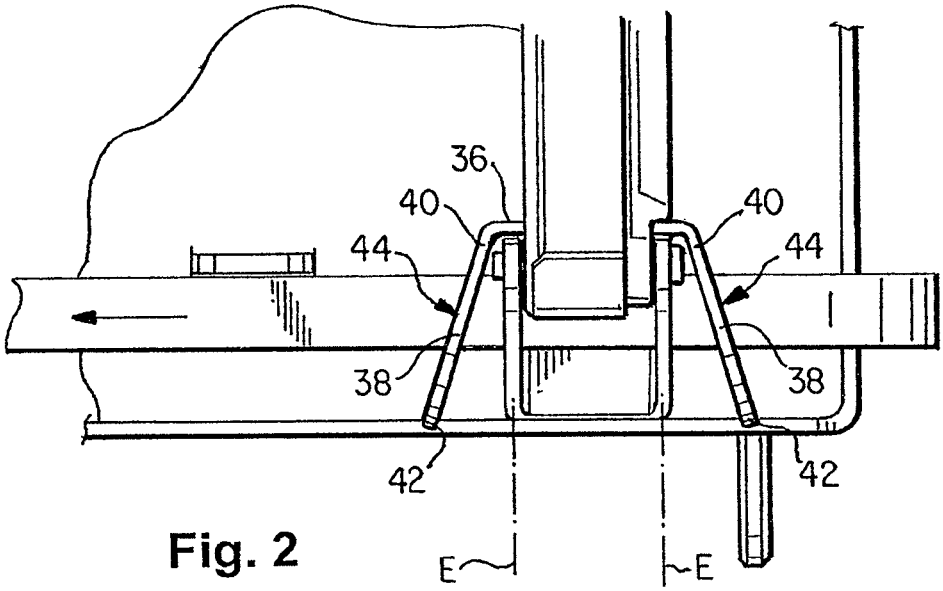
FIG. 2 is a top view of the fastening apparatus of the parallel limit stop from FIG. 1 according to the invention.

As FIG. 2 in particular shows, the locking mechanism 28 is formed by a U-shaped plate with a base 36 as well as legs forming spring elements 38. The base 36 is aligned parallel to the displacement direction R and the spring elements 38 are each inclined in different directions to a plane E perpendicular to the displacement direction R, wherein the angles that the spring elements 38 enclose with the plane E are opposite and equal in terms of size.

The spring elements 38 are respectively held pivotably on the base 36 with a mounting end 40 and have a free end 42. The spring elements 38 can thus be pivoted around the mounting ends 40, thereby changing the angle of the spring elements 38 to the limit stop rail 22.

The spring elements 38 respectively have a recess 44 in the form of a slot through which the limit stop rail 22 is guided.

Figure 3:
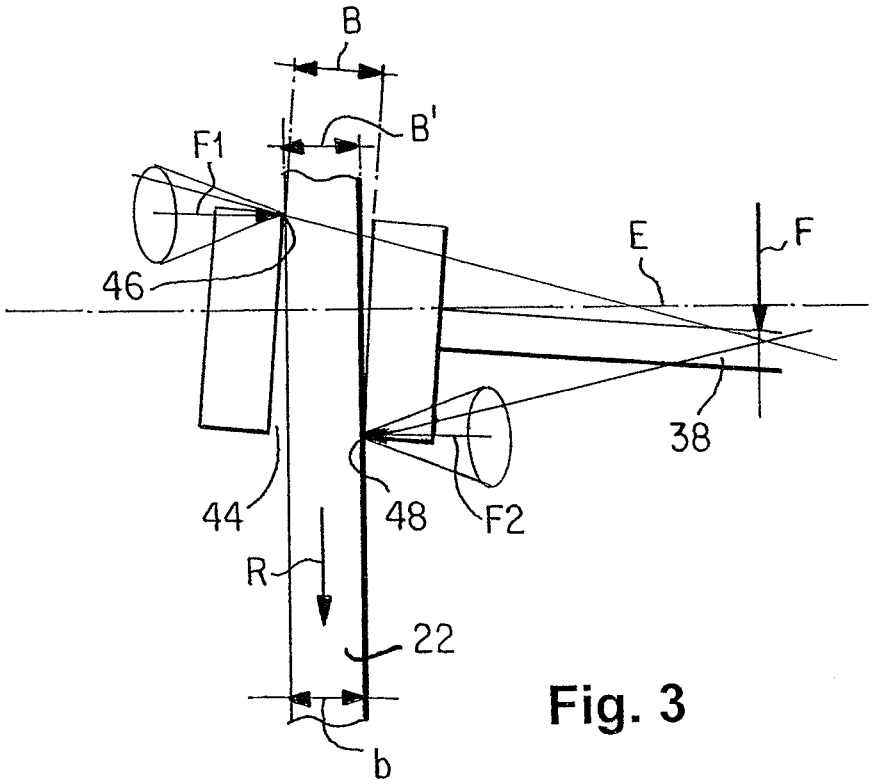
FIG. 3 is a schematic view of a spring element of the fastening apparatus from FIG. 1.

The function of the spring elements 38 will be explained in the following on the basis of a spring element 38 depicted schematically in FIG. 3. The height of the recess 44 corresponds essentially to the height of the limit stop rail 22, but may also be selected to be greater. Only the possibility of a low-friction displacement in the displacement direction R must be ensured. The width B of the recess 44 is selected to be greater than the width b of the limit stop rail 22.

The spring element is in the home position (designated as the locked position here) inclined to a plane E perpendicular to displacement direction R, thereby shortening the projection of the recess 44 on the plane E far enough that the actual insertion width B' is less than the width B and corresponds essentially to the width b of the limit stop rail 22. The spring element 38 cants in this position with the limit stop rail 22. In other words, the edges 46, 48 opposing and limiting the recess 44 make contact with the limit stop rail 22. Because of the spring force F of the spring element 38, which attempts to pivot the spring element 38 further, a respective clamping force F1, F2 directed essentially perpendicular to the displacement direction R is exerted on the edges 46, 48 onto the limit stop rail 22. Because of the opposite clamping forces F1, F2, the limit stop rail 22 is clamped or canted on the spring element 38. The surfaces adjacent to the edges 46, 48 are arranged in this case perpendicular to one another so that they respectively form as sharp an edge as possible, thereby allowing the clamping force to be increased.

To release the locking, the spring element 38 is pivoted against the spring force F into the released position, in which the angle that encloses the spring element 38 with the plane E is flatter. The actual insertion width B' is thereby enlarged until it is greater than the width b of the limit stop rail 22. Due to the larger actual insertion width B', the edges 46, 48 are freed from the limit stop rail 22 so that they are released, and can be moved and aligned in the displacement direction R.

After the spring elements 38 are released, they automatically return to the locked position due to the spring tension so that it is possible to lock the limit stop rail 22 or the limit stop element 20 quickly and without tools.

However, if the limit stop rail 22 is moved against the insertion direction R, it can take the spring element 38 along with it from the locked position into the released position making it possible to release the limit stop rail 22. For this reason, as FIGS. 1 and 2 show, two spring elements 38 are provided, which are arranged as mirror images with respect to the plane E. The spring elements 38 run away from each other towards their free ends 42.

Thickenings are provided on the free ends in order to more easily grip and compress the U-shaped plate (see FIG. 1).

The left spring element 38 in FIG. 2 locks the limit stop rail 22 in the displacement direction R, and the right spring element 38 in FIG. 2 locks it against displacement direction R. As a result, a locking is created in both directions and inadvertent release is ruled out.

As FIGS. 1 and 2 show in particular, a simple operation of the locking mechanism 28 is possible in that the free ends 42 of the spring elements 38 are clasped, for example with the hand, and pressed against the legs 32 of the guide 26. To lock the limit stop rail 22, the spring elements 38 are unclasped so that they can spring back outwardly into the locked position. Therefore, it is possible to adjust the limit stop element 20 simply and quickly.

Instead of the embodiment depicted here, it is also conceivable that the spring elements 38 are not operated directly, but that an additional actuating element is provided, which moves the spring elements 38. This makes a freer arrangement of the fastening apparatus 18 possible and thus of the limit stop element 20 on the tool support plate 14. They may also be arranged for example protected within the housing of the hand circular saw 10. Moreover, it is also conceivable for a common actuating element to be provided for both spring elements 38 so that they can be operated simultaneously. The operating element may be an eccentric for example.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A parallel guide of an electric hand saw, comprising:

a limit stop element; and a fastening apparatus, including:

a guide fastenable on a support plate of the hand saw, wherein the guide defines a slot and wherein the limit stop element is insertable and displaceable through the slot; and a locking mechanism, wherein the limit stop element is lockable in a displacement direction by the locking mechanism;

wherein the locking mechanism extends around the guide and has a spring element, wherein the spring element defines a recess through which the limit stop element is extendable, wherein in a locked position, the limit stop element is clampable by the spring element with a clamping force directed against the limit stop element, and wherein in a released position, the spring element permits a displacement of the limit stop element through the spring element.

2. The parallel guide according to claim 1, wherein in the locked position, the spring element is canted with respect to the limit stop element.

3. The parallel guide according to claim 1, wherein the recess is a slot with a height that corresponds essentially to a height of the limit stop element and with a width that is greater than a width of the limit stop element.

4. The parallel guide according to claim 1, wherein the recess is limited by edges on the spring element and wherein surfaces limiting the edges converge at a right angle to form a sharp edge.

5. The parallel guide according to claim 1, wherein the spring element has a mounting end and a freely cantilevered end and is elongated.

6. The parallel guide according to claim 1, wherein in the locked position, the spring element runs obliquely to the displacement direction and wherein the spring element is pressable against the limit stop element.

7. The parallel guide according to claim 1, further comprising a second spring element, wherein, with respect to the displacement direction, the spring element and the second spring element run obliquely and non-parallel to each other.

8. The parallel guide according to claim 7, wherein the spring elements are connected to one another to form one piece in a form of a U with a base running in the displacement direction and wherein the two spring elements are angled with respect to the base, and wherein sides of the U are mirror images with respect to a plane perpendicular to the displacement direction.

9. The parallel guide according to claim 7, wherein the spring elements are arranged in the displacement direction before and after the guide, respectively.

10. The parallel guide according to claim 1, further comprising an actuating element, wherein the spring element is operable by the actuating element.

11. The parallel guide according to claim 1, wherein the limit stop element has a lower hardness than the spring element.

12. A fastening apparatus for a limit stop element of an electric hand tool, comprising:

a guide fastenable on a support plate of the hand tool, wherein the guide defines a slot and wherein a limit stop element is insertable and displaceable through the slot; and a locking mechanism, wherein a limit stop element is lockable in a displacement direction by the locking mechanism;

wherein the locking mechanism extends around the guide and has a spring element, wherein the spring element defines a recess through which a limit stop element is extendable, wherein in a locked position, a limit stop element is clampable by the spring element with a clamping force, and wherein in a released position, a limit stop element is displaceable through the spring element.

* * * * *